US010758796B2

(12) United States Patent
Kultala et al.

(10) Patent No.: US 10,758,796 B2
(45) **Date of Patent: *Sep. 1, 2020**

(54) DIAMETER PROFILED GOLF CLUB SHAFT TO REDUCE DRAG

(71) Applicant: KARSTEN MANUFACTURING CORPORATION, Phoenix, AZ (US)

(72) Inventors: David S. Kultala, Phoenix, AZ (US); Martin R. Jertson, Phoenix, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/355,482

(22) Filed: Mar. 15, 2019

(65) Prior Publication Data

US 2019/0209903 A1 Jul. 11, 2019

Related U.S. Application Data

(63) Continuation of application No. 15/798,002, filed on Oct. 30, 2017, now Pat. No. 10,272,304.

(Continued)

(51) Int. Cl.
*A63B 53/10* (2015.01)
*A63B 60/00* (2015.01)

(Continued)

(52) U.S. Cl.
CPC ..... *A63B 60/00* (2015.10); *A63B 53/02* (2013.01); *A63B 53/10* (2013.01); *A63B 53/047* (2013.01);

(Continued)

(58) Field of Classification Search
CPC ..... A63B 53/10; A63B 60/00; A63B 53/02; A63B 2060/0081; A63B 2209/02;

(Continued)

(56) References Cited

U.S. PATENT DOCUMENTS 1,713,812 A 5/1929 Barnhart
2,086,275 A 7/1937 Lemmon (Continued)

FOREIGN PATENT DOCUMENTS

JP 56-159159 12/1981
JP 02-102682 4/1990

(Continued)

OTHER PUBLICATIONS

PCT International Search Report and Written Opinion, dated Jan. 8, 2018, for Application No. PCT/US2017/059066, filed Oct. 30, 2017.

(Continued)

*Primary Examiner* — Stephen L Blau

(57) ABSTRACT

A golf club includes a golf club head, a shaft adapter secured within a hosel of the golf club head, and a shaft secured within the shaft adapter. The golf club shaft is formed from a fiber reinforced polymer and extends along a longitudinal axis between a tip end and a grip end. The golf club shaft includes a tip end section, a grip end section, and a tapered section between the tip end section and the grip end section. The tapered section of the shaft includes a reference portion within the upper half that has a frustoconical shape with a near-constant taper rate, and a narrowed portion within the lower half. The narrowed portion is recessed relative to a reference surface extrapolated from the frustoconical shape.

15 Claims, 3 Drawing Sheets

Related U.S. Application Data

(60) Provisional application No. 62/414,492, filed on Oct. 28, 2016.

(51) Int. Cl.
*A63B 53/02* (2015.01)
*A63B 53/04* (2015.01)

(52) U.S. Cl.
CPC ... *A63B 53/0466* (2013.01); *A63B 2053/0479* (2013.01); *A63B 2060/0081* (2015.10); *A63B 2209/00* (2013.01); *A63B 2209/02* (2013.01); *A63B 2225/01* (2013.01)

(58) Field of Classification Search
CPC ..... A63B 2225/01; A63B 2209/00; A63B 2053/0479; A63B 53/047; A63B 53/0466
See application file for complete search history.

(56) References Cited

U.S. PATENT DOCUMENTS

| | | | | | |
|---|---|---|---|---|---|
| 3,519,270 | A * | 7/1970 | Baymiller | A63B 53/007 | 473/313 |
| 3,646,610 | A | 2/1972 | Jackson | | |
| 4,123,055 | A | 10/1978 | Brill | | |
| 5,685,783 | A * | 11/1997 | Akatsuka | A63B 53/10 | 473/319 |
| 5,755,826 | A | 5/1998 | Beach et al. | | |
| 5,820,480 | A * | 10/1998 | Cheng | A63B 53/10 | 473/289 |
| 5,821,417 | A | 10/1998 | Naruo et al. | | |
| 5,882,268 | A | 3/1999 | McIntosh et al. | | |
| 5,904,627 | A | 5/1999 | Miyaji et al. | | |
| 5,935,017 | A | 8/1999 | Weaver et al. | | |
| 5,943,758 | A * | 8/1999 | Haas | A63B 53/10 | 29/516 |
| 6,017,279 | A | 1/2000 | Sumitomo | | |
| 6,056,648 | A * | 5/2000 | Kusumoto | A63B 53/10 | 473/319 |
| 6,117,021 | A | 9/2000 | Crow et al. | | |
| 6,705,954 | B2 | 3/2004 | Takiguchi et al. | | |
| 6,863,623 | B2 * | 3/2005 | Oyama | A63B 53/10 | 473/319 |
| 7,029,402 | B2 * | 4/2006 | Nakajima | A63B 53/02 | 473/309 |
| 7,048,645 | B2 | 5/2006 | Kumamoto | | |
| 7,255,652 | B2 | 8/2007 | Braly et al. | | |
| 7,758,445 | B2 | 7/2010 | Oldenburg | | |
| 8,021,244 | B2 | 9/2011 | Kato | | |
| 8,206,243 | B2 | 6/2012 | Stites | | |
| 8,777,772 | B2 | 7/2014 | Hasegawa et al. | | |
| 8,946,342 | B2 | 2/2015 | Konagai et al. | | |
| 9,295,888 | B2 | 3/2016 | Fujiwara et al. | | |
| 9,339,700 | B2 | 5/2016 | Oyama | | |
| 2004/0142760 | A1 * | 7/2004 | Haas | A63B 53/10 | 473/319 |
| 2005/0079926 | A1 * | 4/2005 | Oldenburg | A63B 53/12 | 473/323 |
| 2005/0282653 | A1 * | 12/2005 | Murphy | A63B 53/02 | 473/305 |
| 2006/0128494 | A1 | 6/2006 | Kumamoto | | |
| 2015/0297963 | A1 * | 10/2015 | Shimono | A63B 60/42 | 473/319 |
| 2016/0325157 | A1 * | 11/2016 | Atsumi | A63B 53/10 | |

FOREIGN PATENT DOCUMENTS

| | | |
|---|---|---|
| JP | 9-262832 | 10/1997 |
| JP | 2004057642 | 2/2004 |
| JP | 2005279098 | 10/2005 |

OTHER PUBLICATIONS

Treu Temper, True Temper DG Spinner Wedge Plus PW/AW Tapered, Amazon, Mar. 7, 2016, http://www.amazon.com/True-Temper-Spinner-Wedge-Tapered/dp/B00KRD9B78.

* cited by examiner

DIAMETER PROFILED GOLF CLUB SHAFT TO REDUCE DRAG

CROSS REFERENCE TO RELATED APPLICATIONS

This application is a continuation of U.S. patent application Ser. No. 15/798,002, filed on Oct. 30, 2017, which claims the benefit of priority from U.S. Provisional Patent Application No. 62/414,492, filed 28 Oct. 2016, which is hereby incorporated by reference in its entirety.

TECHNICAL FIELD

The present invention relates generally to a golf club shaft with improved aerodynamic properties

BACKGROUND

Golf shafts are generally tapering, hollow tubes with a circular cross-section having a minimum outer diameter (OD) at an extreme, tip end where the shaft attaches to a club head and a maximum outer diameter at an opposite extreme, butt end around which a grip is applied. Typical minimum outer diameters range from 0.335" to 0.400". Typical maximum outer diameters range from 0.550" to 0.650". Golf shafts often include substantially cylindrical, parallel sections at the extreme ends to account for hosel (tip) and grip (butt) geometries, and to allow for trimming of the parallel sections (tip trimming to increase stiffness, butt trimming to adjust club length) while maintaining compatibility with hosel and grip. Typical OD taper rates between the extreme ends may vary, but generally range from 0.006 in/in to 0.014 in/in, with driver shaft profiles, for example having a taper of about 0.009-0.010 in/in in the section between the parallel tip and parallel butt.

Increasing a shaft's diameter in a given section is a primary design lever used to increase shaft stiffness without having to add mass or increase material modulus. Lighter shafts are generally beneficial to a golfer in order to reduce effort to swing the club and increase club head speed. Lower modulus materials are typically less expensive and more durable. These reasons drive shaft designs to generally larger diameters. However, aerodynamic drag is increased with larger diameter shafts due to the increased projected area along the path of the shaft in a swing.

Drag force is also proportional to the square of the air flow velocity across the shaft. Since the tip end of the shaft is moving the fastest in a golf swing, the tip end is a significant contributor to drag and reduces club head speed.

While this provided background description attempts to clearly explain certain club-related terminology, it is meant to be illustrative and not limiting. Custom within the industry, rules set by golf organizations such as the United States Golf Association (USGA) or The R&A, and naming convention may augment this description of terminology without departing from the scope of the present application.

DETAILED DESCRIPTION

Figure 1:
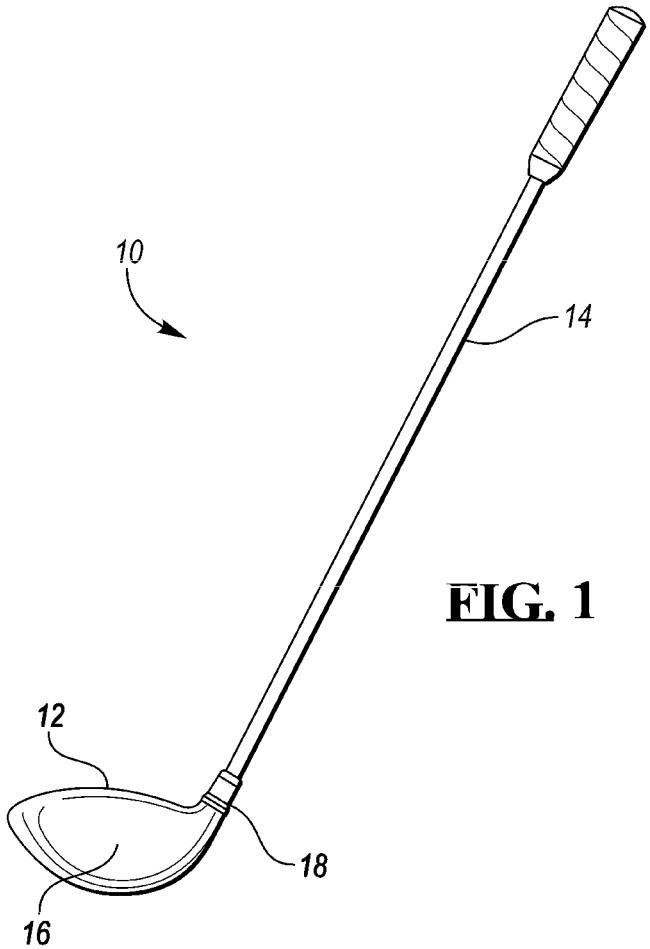
FIG. 1 is a schematic front view of a golf club.

The present embodiments discussed below are directed to a golf club shaft that has improved aerodynamic properties. Recently there have been advancements in the aerodynamic properties of golf club heads in the interest of generating increased club head speed while providing a more aerodynamically stable flight path. Through these developments, the aerodynamic drag contribution of the shaft has become more apparent. Table 1 lists three commercially available driver heads in order of improving aerodynamic head-drag ($C_D$) times projected area (A), and the relative percentage contributions of the head and shaft to the total drag force experienced during a typical swing.

TABLE 1

Relative drag contributions of head vs shaft to overall aerodynamic drag for different available club heads

| Club | Head ($C_D$*A) | Head Contribution | Shaft Contribution |
|---|---|---|---|
| Driver Model A | 2.54 | 60% | 40% |
| Driver Model B | 2.5 | 54% | 46% |
| Driver Model C | 1.85 | 48% | 52% |

Given the increasing relevance of the shaft to the overall drag profile as the head becomes more aerodynamic, there is now a need to focus on the aerodynamic profile of the shaft and to provide a shaft that has a reduced drag profile without significantly altering the balance point or shaft stiffness.

The presently described design improves the aerodynamic properties of a composite shaft by altering the cross-sectional profile/outer diameter of the shaft as a function of length. More specifically, the present shaft may be divided into a tip-end section, a grip-end section, and a tapered section that couples and transitions the tip-end section to the grip-end section. The present design may narrow/recess a portion of lower 60% of the tapered section relative to a frustoconical reference surface that is defined by a portion of the upper 60% of the tapered section. This is in direct contrast to typical shaft designs that either maintain a constant taper or even enlarge a portion of the lower 60% (i.e., relative to the frustoconical reference surface). Enlarged shaft designs have become popular because their geometry alone improves stiffness, without the need for additional reinforcing weight or use of costly advanced materials. Unfortunately, this same design provides an enlarged cross-sectional profile around the portion of the shaft that is moving the fastest, thus greatly increasing drag (i.e., where drag is a function of velocity squared).

To compensate for any reduction in stiffness due to the narrowed shaft portion, the tapered section of the present design may incorporate higher modulus reinforcing fibers (i.e., from about 40 Msi to about 50 Msi), and, for stiffer flex shafts, may even provide additional reinforcing fibers in an orientation that is parallel with the axis. Finally, if higher modulus fibers are used, while the shaft may be stiffer, it may also become more prone to brittle fracture. As such, a shaft adapter that provides adequate cushioning and/or stress distributing qualities may be used to inhibit point-loaded stress concentrations that could result in a failure.

With the modifications described herein, an aerodynamically improved shaft can result in an average increase in club head speed of at least about 0.3-0.4 mph when compared to shafts that may have been used with the clubs described in Table 1 (i.e., while maintaining a similar bending stiffness, weight, and balance point). Under the right conditions and circumstances, this difference in club head speed can translate into approximately 2 additional yards of distance.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The terms "loft" or "loft angle" of a golf club, as described herein, refers to the angle formed between the club face and the shaft, as measured by any suitable loft and lie machine.

As used herein a positive taper rate denotes an expanding shaft outer diameter when moving in a direction from the tip end of the shaft (i.e., the portion directly interconnecting with the golf club head) toward the grip end (i.e., the portion gripped by a user during a traditional golf club swing. In this manner, for a given increment taken along a longitudinal axis of the shaft, a positive taper rate would denote that the grip end of the increment is larger than the tip end of that increment.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes with general reference to a golf club held at address on a horizontal ground plane and at predefined loft and lie angles, though are not necessarily intended to describe permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Referring to the drawings, wherein like reference numerals are used to identify like or identical components in the various views, FIG. 1 schematically illustrates a front view of a golf club 10 that includes a golf club head 12 and an aerodynamic shaft 14. While FIG. 1 schematically illustrates a wood-type club, and more specifically a driver, the aerodynamic shaft concepts disclosed herein have equal applicability with iron, hybrid, rescue, utility or wedge-type club heads. Common to all of these different club head designs is a strike face 16 that is operative to impact a golf ball when the club 10 is swung in an arcuate manner, and a hosel 18 that is operative to receive and secure the shaft 14 to the club head 12.

Figure 2:
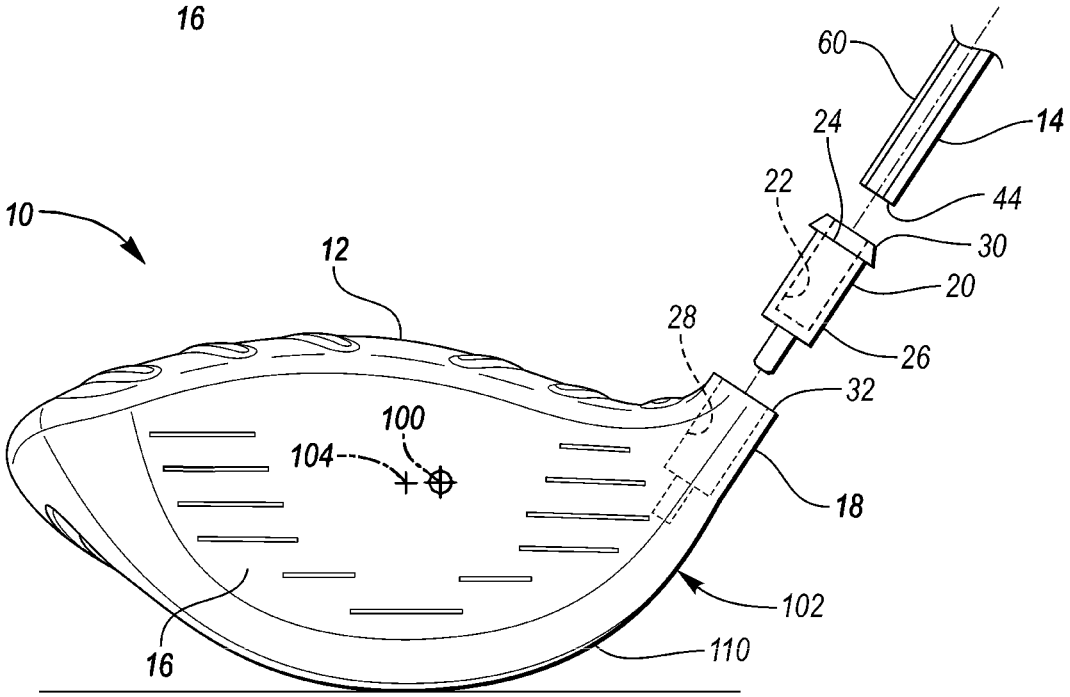
FIG. 2 is a schematic front exploded view of a golf club head, shaft adapter, and golf club shaft.

In the design illustrated in FIG. 2, the golf club shaft 14 may be secured within the hosel 18 through the use of an intermediate a shaft adapter 20. In some embodiments, the shaft adapter 20 may include a generally tubular body 22 having an inner bore 24 adapted to receive the shaft 14, and an outer profile/surface 26 adapted to be secured within a bore 28 of the hosel 18. As further shown in FIG. 2, the shaft adapter 20 may include a strain relief portion 30 that extends beyond a terminal end 32 of the hosel 18. In some embodiments, the strain relief portion 30 may be a separate component that nests within a portion of the tubular body 22 while also extending beyond a terminal edge of the body 22. In some embodiments, the strain relief portion 30 may be formed from a softer and/or more elastic material than the adapter body 22. For example, in one configuration, the strain relief portion 30 may be formed from an elastomer including a rubber or thermoplastic elastomer, whereas the adapter body 22 may be formed from an engineering polymer or metal. The strain relief portion 30 may provide a cosmetic transition between the hosel 18 and the shaft 14, while also better distributing sheer stresses in the shaft 14. Examples of shaft adapters with cushioning attributes for use in the present design are further described in U.S. patent application Ser. No. 15/003,494 (U.S. Publication No. 2016-0136487, which is incorporated by reference in its entirety.

Figure 3:
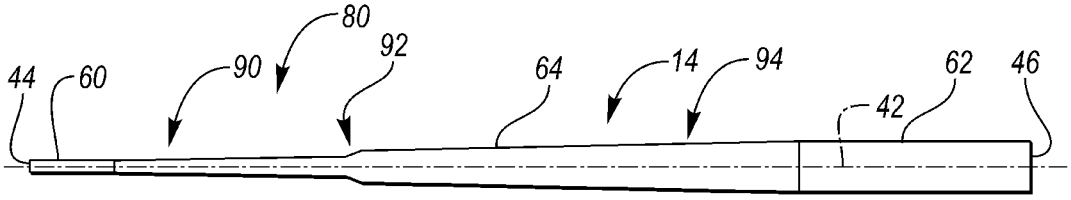
FIG. 3 is a schematic side view of an embodiment of an aerodynamic golf club shaft.

FIG. 3 schematically illustrates an embodiment of an aerodynamic shaft 14 that has a reduced cross-sectional profile for the purpose of reducing aerodynamic drag during a user's swing. As generally shown, the aerodynamic shaft 14 extends along a longitudinal axis 42 between a tip end 44 and a grip end 46. For the purposes of this disclosure, portions of the shaft closest to the tip end 44 may generally be referred to as the "lower" portions of the shaft 14, while portions of the shaft closest to the grip end 46 may be referred to as the "upper" portions of the shaft 14. Likewise, if not otherwise specified, any dimensional lengths mentioned herein can be assumed to be measured from the tip end 44 toward the grip end 46.

Figure 4:
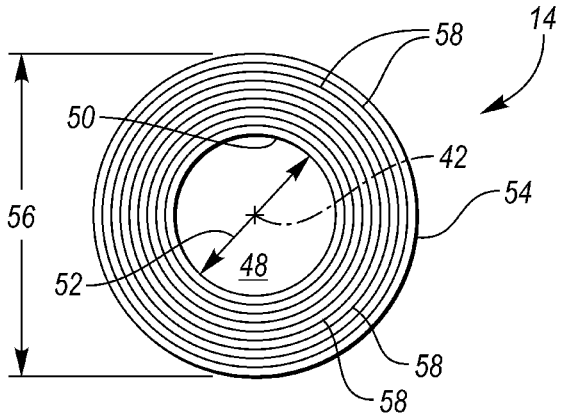
FIG. 4 is a schematic cross-sectional view of the shaft of FIG. 3, taken perpendicular to the longitudinal axis.

As shown in FIG. 4, the present shaft 14 is generally circular and symmetric about the longitudinal axis 42. The shaft 14 includes a hollow inner recess 48, an inner surface 50 defining an inner diameter 52, and an outer surface 54 defining an outer diameter 56.

The shaft 14 of the present design is formed from a fiber reinforced composite material that comprises a plurality of discrete layers 58 of fabric embedded in a hardened polymer resin matrix. In such constructions, it is typical for each layer 58 of fabric to be formed from a collection unidirectionally oriented reinforcing fibers. Examples of fibers that may be used include in the present design include carbon fibers and aramid polymer fibers. Furthermore, in an embodiment, the various layers 58 are fused together using one or more thermosetting resins that may be pre-impregnated into the various fabric layers 58 and then cured en masse following the construction of the layup.

As is known and understood in the art of composite shafts, the orientation of the unidirectional fibers in each layer 58 contributes different qualities to the finished shaft. For example, layers 58 oriented parallel to the longitudinal axis 42 (i.e., 0 degree) increase the bending stiffness of the shaft 14, layers 58 angled obliquely relative to the longitudinal axis 42 (e.g., 45 degree) increase the torsional stiffness of the shaft 14, and layers 58 oriented transverse to the longitudinal axis 42 (i.e., 90 degree) increase the hoop strength and/or crush strength of the shaft 14. Any composite shaft may typically utilize a combination of 0, 45, and 90 degree layers. For example, in a region of the tip (e.g., within about 8 inches of the end of the shaft), it is common for a shaft to have about 10-16 total composite layers 58.

Due to variations in fiber size and density, it is common for fabrics to be described in terms of an Areal Weight (or weight per unit area). In the present disclosure, unless otherwise specified, all references to Fiber Areal Weight (FAW) are meant to refer to the fiber weight per unit area of the composite as a whole. Such a measure provides a better approximation for quantity or mass of fibers that may be oriented in a particular direction than, for example, by reference to a number of layers. Table 2, below, illustrates shaft parameters for a typical club, including 0-degree FAW, and 45-degree FAW.

Table 2 is categorized into five different flex designation for a typical club head, with the flex of the shaft increasing reading from left-to-right of Table 2. The flex designation of the shaft is determined individually through a standard butt frequency test. The shaft, all with the same length of 46 inches, are clamped onto the testing apparatus, six inches from the butt end of the shaft. A weight housing device is then coupled to the tip end of the shaft, and a weight of 205 grams is screwed onto the weight housing device. This allows the CG of the shaft to be located at the tip end of the shaft as a control variable for testing. A downward force is then applied to the tip end of the shaft to generate shaft oscillation. The frequency is then measured in cycles per minute of the oscillations of the shaft. As illustrated in Table 2, the highest flex/lowest stiffness (L) comprises a flex butt frequency of 192-222 CPM; the moderate-high flex (SR) comprises a flex butt frequency of 202-244 CPM; the regular flex (R) comprises a flex butt frequency of 234-260 CPM; the moderate-low flex (S) comprises a flex butt frequency of 261-285; and the least flex/higher stiffness (X) comprises a flex butt frequency of 280-304 CPM.

TABLE 2

Typical composite shaft construction by target club head swing speed.

| | Driver Speed (mph) | | | | |
|---|---|---|---|---|---|
| | <70 | <80 | <90 | <100 | 100+ |
| Flex Designation | L | SR | R | S | X |
| Flex Butt Frequency (CPM) | 192-222 | 202-244 | 234-260 | 261-285 | 280-304 |
| Shaft Weight (g) | 35-50 | 40-55 | 45-60 | 50-65 | 55-70 |
| CG location (in from grip end) | 19-22 | 18-22 | 18-22 | 18-22 | 18-22 |
| 0-Degree Avg. Modulus (Msi) | 30-36 | 34-40 | 36-42 | 38-44 | 40-46 |
| 0-Degree FAW ($g/m^2$) | 500-575 | 575-625 | 625-675 | 675-725 | 725-775 |
| +/−45-Degree FAW ($g/m^2$) | 500-575 | 500-575 | 500-575 | 500-575 | 500-575 |

Referring again to FIG. 3, the shaft 14 may generally include a tip end section 60 abutting the tip end 44, a grip end section 62 abutting the grip end 46, and a tapered section 64 between the tip end section 60 and the grip end section 62. The tip end section 60 is generally the portion of the shaft 14 that is used to secure the shaft 14 with the club head 12. More specifically, in an assembled golf club 10, at least a portion of the tip end section 60 is secured within the hosel 18 and/or within the shaft adapter 20, such as through the use of adhesives and/or mechanical attachment means such as a screw. In an embodiment, the tip end section 60 may be cylindrical, and may have an outer diameter 56 of from about 0.275 inches to about 0.315 inches, or from 0.275 inches to about 0.300 inches, or from about 0.300 inches to about 0.315 inches, or even from about 0.307 inches to about 0.312 inches. For example, the outer diameter 56 of the tip end section 60 can be 0.275 inches, 0.280 inches, 0.285 inches, 0.290 inches, 0.295 inches, 0.300 inches, 0.305 inches, 0310 inches, 0.315 inches. In other embodiments, the outer diameter 56 of the tip end section 60 may be tapered, for example, at a rate of from about 0.000 inches change in outer diameter per linear inch of shaft length, measured along the longitudinal axis 42 in a direction from tip to grip (hereinafter referred to as "inch/inch") to about 0.010 inch/inch or more. Additionally, the length of the tip end section 60 may be from about 1 inch to about 5 inches, or from about 1 inch to about 3 inches, or from about 1.75 inches to about 2.25 inches, or from about 3 inches to 5 inches, or from about 3.25 inches to about 4.75 inches, measured from the tip end 44. For example, the length of the tip end section 60 can be 1 inch, 1.50 inches, 2 inches, 2.50 inches, 3 inches, 3.50 inches, 4 inches, 4.50 inches, or 5 inches.

The grip end section 62 generally represents the portion of the shaft that is intended to be gripped by the user during a typical golf swing. The grip end section 62 is adapted to extend within a complimentary grip that forms the outer tactile surface of the club 10. Typical grips can be formed from a rubber, leather, or synthetic leather material. The grip end section 62 may generally extend in length from the grip end 46 of the shaft 14 by about 4 inches to about 16 inches, or more typically by about 8 inches to about 12 inches. Some or all of the grip end section 62 may be cylindrical and/or some or all of the grip end section 62 may have an increasing taper. In either case, the average outer diameter 56 of the grip end section 62 is from about 0.500" to about 0.650" with a maximum outer diameter of from about 0.550" to 0.650".

Between the tip end section 60 and the grip end section 62 is a tapered section 64 that transitions the diameter of the shaft 14 from the smaller outer diameter of the tip to the larger outer diameter of the grip. It is within this section where the improved aerodynamic qualities of the present shaft 14 are recognized.

Figure 5:
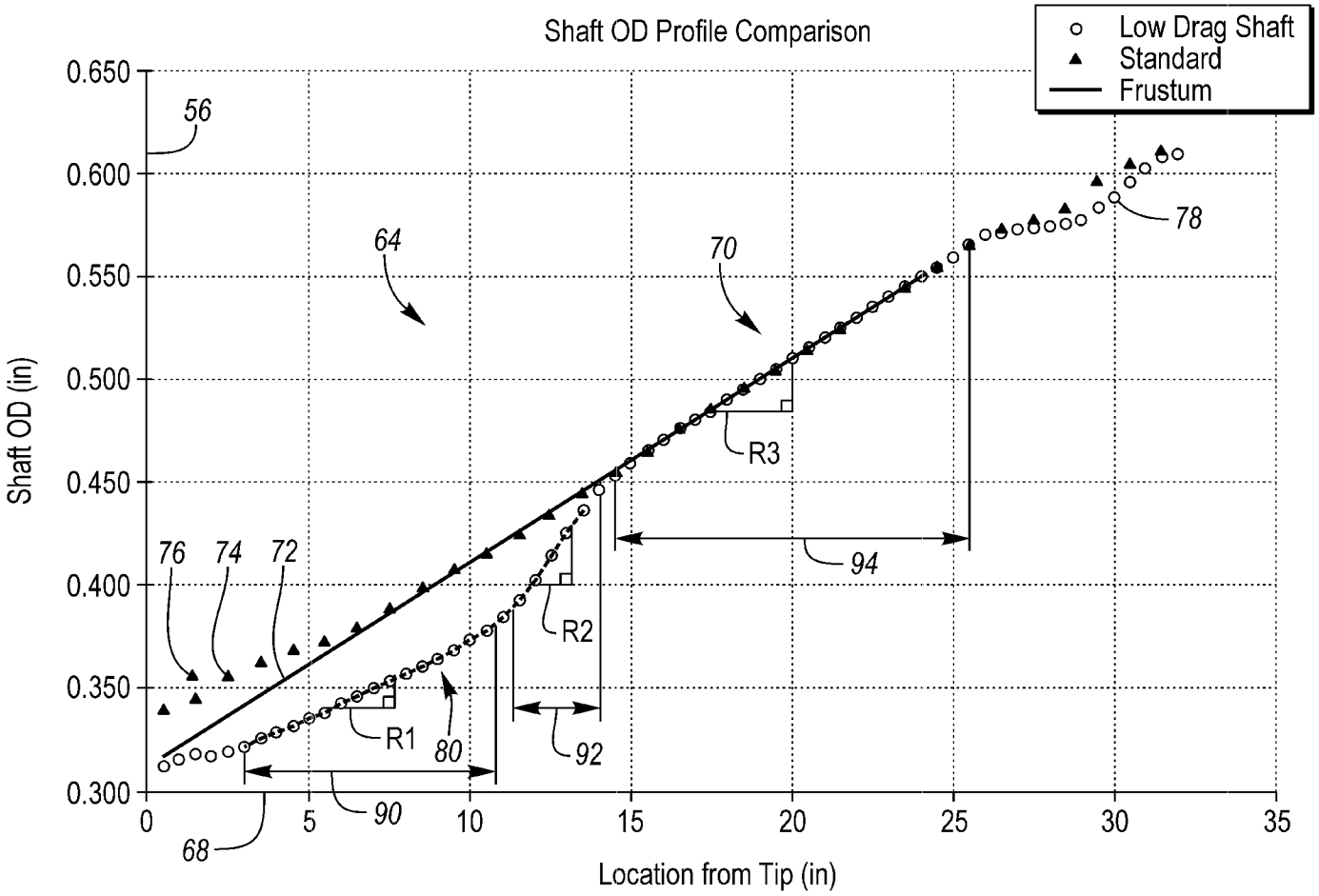
FIG. 5 is a schematic graph of the outer diameter profile of an embodiment of the aerodynamic golf club shaft of FIG. 3 compared with the outer diameter profile of a reference shaft.

FIG. 5 generally illustrates a graph of the outer diameter 56 of the tapered section 64 of two different shafts (i.e., a reference shaft and the aerodynamically improved shaft) as a function of distance 68 from the tip-most end of the section 60. As shown, while taper rates may vary across the length of the tapered section 64, it is common for at least a portion 70 of the outer surface 54 of about the about the upper 45%, about the upper 50%, about the upper 55%, of about the upper 60% of the tapered section 64 to approximate a frustoconical shape having a near-constant taper rate (i.e., "near-constant taper rate" meaning a taper rate having a maximum variance of about +/−0.001 inch/inch). As generally shown in FIG. 5, this frustoconical shape may be extrapolated toward the tip end 44 to serve as a general reference surface 72 from which to compare differences in shaft outer diameter 56.

As noted above, in many existing shafts (e.g., reference shaft 74), it is common for the shaft 14 to either follow the frustoconical reference surface 72 straight to the tip end section 60, or else a portion 76 of the tip end of the tapered section 64 may be enlarged relative to the frustoconical reference surface 72. This larger diameter generally provides enhanced bending and torsional stiffness at or near the tip (attributable to the greater bending and torsional moments of inertia), while avoiding the need to add weight or use more expensive, higher modulus fibers. While the larger diameter contributes to improved stiffness and the ability to use lower modulus materials, this same design provides a larger aerodynamic drag profile at the portion of the club head that is moving the fastest during a normal swing.

In contrast to prior designs, the profile 78 of the present golf club shaft 14 includes a portion 80 of the lower 60% of the tapered section 64 that is narrowed/recessed relative to both the reference shaft 74 and the frustoconical reference surface 72 (i.e., the "narrowed portion 80"). By narrowing the outer profile of this portion 80, the aerodynamic drag of the shaft is reduced, resulting in potentially greater club head speeds. It has been found that these speed gains are the most significant if the narrowed portion is located within about the lowest 10 to 12 inches, or about the lowest 8 to 15 inches, or about the lowest 8 to 11 inches, or about the lowest 11-15 inches of the tapered section 64. For Example, the speed gains are the most significant if the narrowed portion is located within about the lowest 8 inches, 9 inches, 10 inches, 11 inches, 12 inches, 13 inches, 14 inches, or 15 inches.

In some embodiments at least 40% of the narrowed portion 80, measured along the longitudinal axis 42, may have an the outer diameter 56 that is more than about 6% smaller than the frustoconical reference surface 72 at the same location. In some embodiments, at least 50% of the narrowed portion 80 may have an outer diameter 56 that is more than about 6% smaller than the reference surface 72. Also, in some embodiments, at least 50% of the narrowed portion 80 may have an outer diameter 56 that is more than about 7% smaller than the reference surface 72. Also, in some embodiments still, at least 40% of the narrowed portion 80 may have an outer diameter 56 that is more than about 8% smaller than the reference surface 72.

In the embodiment illustrated in FIG. 5, >80% of the length of the narrowed portion 80 is >3% smaller than the diameter of the frustoconical reference surface 72 at the same location; >75% of the length of the narrowed portion 80 is >4% smaller than the diameter of the frustoconical reference surface 72; >70% of the length of the narrowed portion 80 is >5% smaller than the diameter of the frustoconical reference surface 72; >60% of the length of the narrowed portion 80 is >6% smaller than the diameter of the frustoconical reference surface 72; >50% of the length of the narrowed portion 80 is >7% smaller than the diameter of the frustoconical reference surface 72; >30% of the length of the narrowed portion 80 is >8% smaller than the diameter of the frustoconical reference surface 72; and >15% of the length of the narrowed portion 80 is >9% smaller than the diameter of the frustoconical reference surface 72.

With further reference to FIG. 5, approximately the first 14 inches of the illustrated embodiment 78 is narrowed relative to the reference shaft 74. Within this section, about the first 11 inches is narrowed by greater than about 7% relative to the reference shaft 74, and about 9 inches of the present profile 78 is narrowed by greater than 9% relative to the reference shaft 74.

Some embodiments of the present design may include a tapered section 64 that has a plurality of different regions along its length, where at least one intermediate region has a taper rate that is greater than regions on opposing sides of that region. In effect, this region with an increased taper rate may serve as a comparatively aggressive transition between a narrower part of the narrowed portion 80 and the portion 70 of the upper 50% that approximates a frustoconical shape. In some embodiments, the tapered section 64 can comprise 2 regions, or more than 2 regions (e.g., 3 regions, 4, regions, 5, regions, 6 regions, 7 regions, 8 regions, 9 regions, or etc.) For example, the tapered section 64 illustrated in FIG. 5 has at least three primary regions: a first region 90 with a first taper rate R1, a second region 92 with a second taper rate R2, and a third region 94 with a third taper rate R3. The first region 90 is closest to the tip end 44, the third region 94 is located closest to the grip end 46, and the second region 92 is positioned between the first region 90 and the third region 94. As illustrated via FIG. 5, R2 is more aggressively tapered than either of the two bounding regions 90, 94 (i.e., where R2>(R1 and R3)). As further shown, in some embodiments, the first region 90 may have a shallower inclination/taper than the third region 94 (i.e., where R1<R3), and in some embodiments R2>R3>R1>0. The comparatively shallower inclination across the most narrowed, first region 90 would ensure that region has the smallest possible average outer diameter to provide the most improved aerodynamic gains.

In an embodiment, the first taper rate R1 may be from about 0.004 to about 0.012 inch/inch, or from about 0.005 to about 0.010 inch/inch, from about 0.006 to about 0.009 inch/inch, from about 0.004 to about 0.008 inch/inch, or even from 0.008 to 0.0012 inch/inch. The second taper rate R2 may be from about 0.015 to about 0.030 inch/inch, or about 0.018 to about 0.027 inch/inch, from about 0.020 to about 0.025 inch/inch, from about 0.015 to 0.022 inch/inch, or even from about 0.022 to 0.020 inch/inch. Finally, the third taper rate R3 may be from about 0.005 to about 0.014 inch/inch, or from about 0.007 to about 0.012 inch/inch, from about 0.009 to about 0.010 inch/inch, from about 0.005 to about 0.010 inch/inch, or even from about 0.010 to about 0.014 inch/inch.

In some embodiments, the first region 90 and second region 92 may be located entirely within the 60% of the tapered region 64 closest to the tip end 44. In other embodiments, the first region and second region can be located within 55%, 50%, 45%, or 40% of the tapered region 64 closest to the tip end 44. Likewise, in some embodiments, the first region 90 and second region 92 may be located entirely within about the first 20 inches of the tapered region 64 closest to the tip end 44. In other embodiments, the first region 90 and second region 92 may be located entirely within about the first 18 inches, 15 inches, or even the first 12 inches of the tapered region 64

Figure 6:
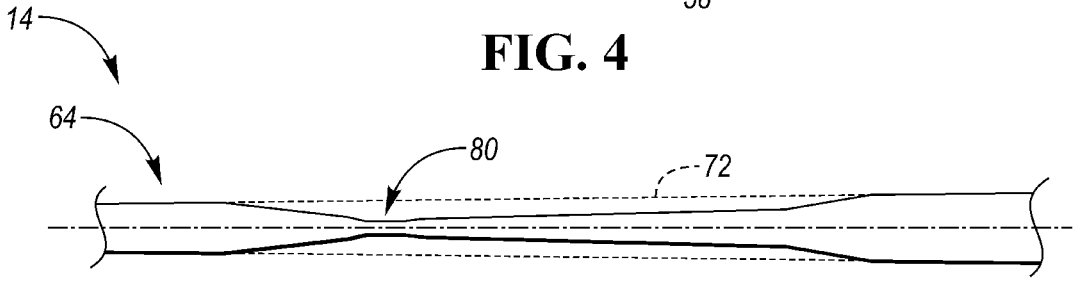
FIG. 6 is a schematic side view of another embodiment of an aerodynamic golf club shaft.

While FIGS. 3 and 5 illustrate an embodiment where the narrowest portion of the tapered section 64 is at the tip end of that section, FIG. 6 illustrates an embodiment where the narrowest portion is located further up the shaft 14. Such an embodiment still has at least one intermediate region has a taper rate that is greater than regions on opposing sides of that region, however FIG. 6 illustrates that additional regions may also exist and/or that the three regions need not form the entire tapered section. In still other embodiments, profiles may exist where instead of R2>(R1 and R3), the profile may more generically be described by R3<(R1 and R2). Such embodiments may permit the first region 90 and section region 92 to have the same taper rates.

As noted above, for similar material constructions, a larger diameter shaft generally provides greater bending and torsional stiffness than a smaller diameter shaft. For example, if all other variables and materials are held constant, the narrowed profile 78 of the present shaft would be about 25-30% less stiff than the reference design 74. Lower bending stiffness has a tendency to cause the club head to lead (ahead of grip axis along swing path) and close at impact, and lower torsional stiffness has a tendency to cause the club head to dynamically loft and/or open at impact. It has been found that much of a golf club's "feel" has to do with the proper matching of bending stiffness to a golfer's swing speed. Moreover, if a user's club head is not stiff enough for their given swing speed, their ability to make consistent square impact between the strike face 16 and a golf ball greatly decreases.

To compensate for the reduced bending stiffness and provide the user with desirable swing feel and/or launch conditions, the present design may utilize comparatively higher modulus fibers within some or all of the fiber-reinforced composite layers 58 in the narrowed portion 80. More specifically, bending stiffness is equal to Young's Modulus times the moment of inertia of the design (E*I). A reduction in I can be offset by a corresponding increase in E. Unfortunately, as the modulus of the fibers increases, so too does the likelihood for brittle fracture. It has been found that a reasonable upper bound for the fiber modulus is in the range of about 45 Msi to about 50 Msi (for example 45 Msi, 46 Msi, 47 Msi, 48 Msi, 49 Msi, or 50 Msi). Therefore, with reference to Table 2, above, while it may be possible to offset the stiffness reduction in softer-flex shafts solely with fiber substitutions, stiffer-flex shafts are limited out due to durability concerns.

In one embodiment, a secondary approach to restoring/increasing stiffness may be to add or reorient one or more fiber layers 58 to be parallel to the longitudinal axis 42 (i.e., 0 degree). This approach may be beneficial when increases in the modulus are limited for durability reasons. Table 3 illustrates example ranges and changes (relative to Table 2) for the modulus and FAW of a narrowed portion 80 of an embodiment of a low-drag shaft.

TABLE 3

Low-Drag shaft construction by target club head swing speed.

| | Driver Speed (mph) | | | | |
|---|---|---|---|---|---|
| | <70 | <80 | <90 | <100 | 100+ |
| Flex Designation | L | SR | R | S | X |
| Flex Butt Frequency (CPM) | 192-222 | 202-244 | 234-260 | 261-285 | 280-304 |
| Shaft Weight (g) | 35-50 | 40-55 | 45-60 | 50-65 | 55-70 |
| CG location (in from grip end) | 19-22 | 18-22 | 18-22 | 18-22 | 18-22 |
| 0-Degree Avg. Modulus (Msi) | 40-46 | 40-46 | 40-46 | 40-46 | 43-49 |
| Nominal Δ; 0-Degree Modulus | 10 | 6 | 4 | 3 | 3 |
| 0-Degree FAW (g/m$^2$) | 500-575 | 635-685 | 720-770 | 805-855 | 925-975 |
| Nominal Δ; 0-Degree FAW | 0 | 60 | 95 | 130 | 200 |

In some embodiments, the increased fiber modulus and/or greater FAW, such as described in Table 3, may extend throughout some or all of the narrowed portion 80. In some embodiments, the degree of the increased stiffening may be a function of the diameter reduction. For example, more aggressively narrowed portions, such as the first region 90 described above, may have stiffer fibers and/or a greater FAW than a tapering/transition region that is less-narrowed (e.g., the second region 92). In still other embodiments, the increased fiber modulus and/or greater FAW may extend beyond the narrowed portion 80 (e.g., partially into the third region 94). By extending beyond the narrowed portion 80, it is possible to provide a comparable overall shaft stiffness, while the narrowed portion 80 remains comparatively less stiff when viewed in isolation (i.e., comparing to the reference club). This design may be beneficial particularly in the stiff and x-stiff shafts, where the bulk of the stiffness increases occur by increasing FAW.

While bending stiffness may be improved/restored by orienting more fibers/composite layers along the longitudinal axis 42 and/or by using higher modulus materials, the reduction in shaft diameter may also reduce the torsional stiffness of the shaft 14. In some embodiments, torsional stiffness may be restored in much the same way as bending stiffness. More specifically, higher modulus fibers may be utilized in the 45-degree layers, and then FAW in this orientation may be increased if necessary.

In some embodiments, an optimization or balancing of bending and torsional stiffnesses may be performed before directly resorting to progressively higher modulus materials (which could present durability concerns) or a greater FAW (which can alter mass properties) in the 45-degree layers. In particular, a lower bending stiffness may tend to deliver a closed face at impact, whereas a lower torsional stiffness tends to deliver a more open face at impact. As such, some bending stiffness may be sacrificed to provide additional 45-degree stiffness before feel is significantly affected. In this manner, the greater torsional stiffness would reduce some of the open-face tendency, while the reduced bending stiffness would tend to close the face and further reduce the open-face tendency. In a preferred embodiment, however, bending stiffness of the present design is desirably within about 10% of the reference club, more preferably is within about 5% of the reference club, and more preferably is within about 3% of the reference club.

In some embodiments where bending stiffness is maintained within about 10% of the reference shaft 74 and torsional stiffness is below a target stiffness, any remaining open-face tendencies can also be accounted for through changes in the club head 12 design (i.e., before resorting to adding additional 45-degree fibers). For example, in one embodiment, the club head center of gravity (CG) 100 (shown in FIG. 2) may be moved closer to the heel 102 than for a head intended to be used with the reference shaft. Such a CG adjustment has the effect of both reducing the torsional stresses imparted to the shaft during a swing, while also resulting in a more draw-biased gear-effect at impact. In one embodiment, the CG of the club head 12 may be moved such that it is located between the geometric center 104 of the club head 12 and the heel 102. Additionally, modifications to the face geometry (e.g., bulge radius and offset) may further be used to account for the comparatively lower shaft torsional stiffness.

In an embodiment where higher modulus fibers (40 Msi and above) are used to maintain the stiffness of the shaft similar to that of the reference shaft 74, additional care must be taken to guard against impact-related brittle fractures. For example, as mentioned above, the golf club 10 may utilize a shaft adapter 20 that is designed to minimize stress concentrations and/or provide a cushioning aspect between the shaft 14 and the hosel 18. Such a shaft adapter 20 may utilize a combination of design and material selection to better distribute and/or dampen impact stresses against the shaft 14. This stress reduction/distribution reduces the likelihood of the composite shaft material fracturing under impact loads, and has been found to improve durability by about 10% to about 22%. In other embodiments, the cushioning aspect of the shaft adapter 20 can improve durability of the shaft 14 by about 12% to about 20%, about 14% to about 18%, about 10% to about 16%, or about 16% to about 22%. For example, the shaft adapter 20 can improve shaft 14 durability by 10%, 12%, 14%, 16%, 18%, 20%, or 22%.

In addition to simply providing a cushioning aspect, in some embodiments, the shaft adapter 20 may further include reinforcing attributes that extend within the inner diameter 52 of the tip end 44 of the shaft 14. An example of such a design is described and illustrated in US 2017/0252611 (the '611 Application), which is incorporated by reference in its entirety. A version of the adapter described in the '611 Application could be incorporated into the shaft during manufacturing as an extension to a mandrel in the rolling process. More specifically, a small diameter shaft can require a mandrel having a very small diameter that is prone to breakage or deformation. A sleeve that attaches to the mandrel tip and stays within the shaft after curing can reduce the likelihood of mandrel issues and increase the strength of the shaft tip by internal reinforcement (reduces buckling at the shaft tip from within).

While it is feasible to manufacture shafts with minimum outer diameters down to 0.275" that have a comparable weight and balance point as the reference shaft 74, such shafts would require considerably stiffer materials to provide a comparable stiffnesses. Unfortunately, even with the use of cushioning shaft adapters, such diameters have been found to be prone to brittle fracture, and thus would not be sufficiently durable to be commercially viable. To provide a club that is sufficiently durable to withstand repeated, it has been found that a minimum outer diameter of about 0.300" to about 0.325" is generally required using current techniques and available materials. Through testing, it has been found that a minimum outer diameter in the range of from about 0.305" to about 0.312", when paired with a cushioning shaft adapter, such as described and incorporated by reference above, provides a suitable balance of durability and performance without requiring additional reinforcement within the shaft (which may negatively alter the balance point/swing weight of the club).

Through testing, it has been found that the shaft profile 78 illustrated in FIG. 5 can result in an average increase in club head speed of about 0.3-0.4 mph (e.g., 0.300 mph, 0.310 mph, 0.320 mph, 0.330 mph, 0.340 mph, 0.350 mph, 0.360 mph, 0.370 mph, 0.380 mph, 0.390 mph, and 0.400 mph) when compared to a shaft with the reference profile 74 and having a similar stiffness, weight, and balance point. This difference in club head speed can translate into approximately 2 additional yards of distance under the right circumstances.

It should be noted that the above examples, including the comparison and designs shown in FIG. 5, are provided for illustrative purposes. In other embodiments, instead of being near the tip, it is possible to locate the narrowed portion 80 in a central region of the tapered section 64 (shown in FIG. 6), or to even include narrowed portions that undulate along the length, have increasing and/or decreasing tapers, or shafts that include a plurality of narrowed portions along the length. Common to all of these designs is simply a reference portion that defines a frustoconical reference surface, and a narrowed portion that is closer to the tip than the reference portion, and is recessed/narrowed relative to the reference surface, In embodiments such as shown in FIG. 6, where the narrowed portion 80 is located in a central region of the tapered section 64, the narrowed portion may have a comparatively greater reduction in diameter relative to the frustoconical reference surface 72, particularly because impact stresses experienced through the mid section of the shaft are generally lower than those experienced near the tip 44.

Figure 7:
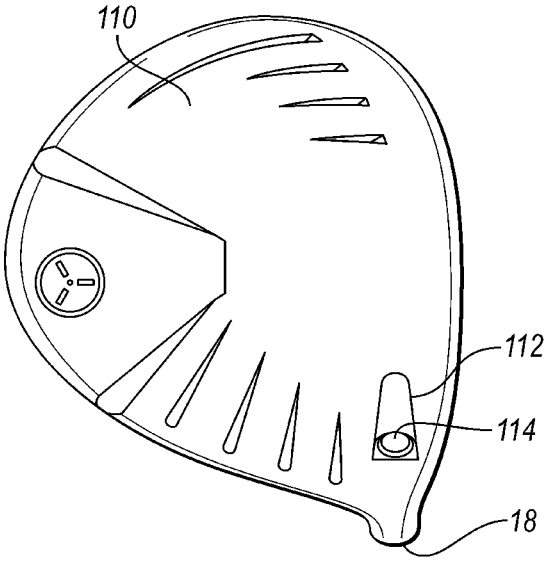
FIG. 7 is a schematic bottom view of a golf club head having a tapered hosel opening.

In some embodiments (illustrated in FIG. 7), to further improve the aerodynamic qualities of the golf club 10, the hosel 18 may meet the sole 110 at a location that defines a tapered notch 112. The notch 112 is configured to receive a screw 114 to provisionally secure the shaft 14 within the club head 10. The notch 112 includes a depth and a cross sectional area taken along a plane positioned perpendicular to the hosel axis. The cross sectional area of the notch 112 varies along the hosel axis. Specifically, the cross sectional area decreases with increasing distance from the hosel 18. Accordingly, the notch 112 tapers in a direction toward the exterior surface of the sole 110. The tapered notch 112 results in a reduced gap in the exterior surface of the sole compared to a club head having a notch with a constant cross sectional area. Reducing the gap size of the notch 112 can improve the aerodynamic characteristics of the club head 12 by creating a smoother surface for air flow over the club head during a swing. In some embodiments, the depth of the notch 112 is reduced compared to current hosel 18 notch depths to further reduce the notch volume.

The tapered notch 112 described herein further has a reduced volume compared to a notch with a constant cross sectional area and/or greater depth, while maintaining adequate clearance for a torque wrench to adjust the hosel configuration. Reducing the notch volume can further improve the aerodynamic characteristic of the club head by reducing the drag associated with airflow over the club head during a swing.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf club, the apparatus, methods, and articles of manufacture described herein may be applicable to other types of golf club such as a driver wood-type golf club, a fairway wood-type golf club, a hybrid-type golf club, an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1: A golf club comprising a golf club head comprising a strike face and a hosel, a shaft adapter secured within the hosel and defining an internal bore, a golf club shaft formed from a fiber reinforced polymer and extending along a longitudinal axis between a tip end and a grip end, the golf club shaft including a tip end section abutting the tip end, wherein the tip end section is at least partially secured within the internal bore of the shaft adapter, a grip end section abutting the grip end, and a tapered section interconnecting the tip end section and the grip end section, wherein the tapered section includes an upper 60% and a lower 60% along the longitudinal axis, the upper 60% abutting the grip end section, and the lower 60% abutting the tip end section, the tapered section further including a reference portion at least partially located within the upper 60%, wherein the outer surface of the reference portion has a frustoconical shape with a near-constant taper rate, a narrowed portion at least partially located within the lower 60% and between the tip end and the reference portion, wherein the outer surface of the narrowed portion is recessed relative to a reference surface extrapolated from the frustoconical shape toward the tip end.

Clause 2: The golf club of clause 1, wherein the narrowed portion comprises a first region having a first taper rate (R1) and a second region having a second taper rate (R2), wherein the second region is between the first region and the reference portion, and wherein R2>R1.

Clause 3: The golf club of clause 2, wherein the near-constant taper rate (R3) of the reference portion is less than R2.

Clause 4: The golf club of clause 3, wherein R1<R3.

Clause 5: The golf club of clause 1, wherein the tapered section has a length of greater than about 30 inches, and wherein the first region is located entirely within about the first 15 of the tapered section closest to the tip end section.

Clause 6: The golf club of clause 1, wherein the fiber reinforced polymer of the narrowed portion comprises a plurality of fibers oriented parallel to the longitudinal axis (0-degree fibers), and wherein the golf club shaft has one of a bending stiffness of from about 192 CPM to about 222 CPM, an elastic modulus of the 0-degree fibers of from about 40 Msi to about 46 Msi, and a Fiber Areal Weight of the 0-degree fibers of from about 500 $g/m^2$ to about 575 $g/m^2$, a bending stiffness of from about 202 CPM to about 244 CPM, an elastic modulus of the 0-degree fibers of from about 40 Msi to about 46 Msi, and a Fiber Areal Weight of the 0-degree fibers of from about 635 $g/m^2$ to about 685 $g/m^2$, a bending stiffness of from about 234 CPM to about 260 CPM, an elastic modulus of the 0-degree fibers of from about 40 Msi to about 46 Msi, and a Fiber Areal Weight of the 0-degree fibers of from about 720 $g/m^2$ to about 770 $g/m^2$, a bending stiffness of from about 261 CPM to about 285 CPM, an elastic modulus of the 0-degree fibers of from about 40 Msi to about 46 Msi, and a Fiber Areal Weight of the 0-degree fibers of from about 805 $g/m^2$ to about 855 $g/m^2$, or a bending stiffness of from about 280 CPM to about 304 CPM, an elastic modulus of the 0-degree fibers of from about 43 Msi to about 49 Msi, and a Fiber Areal Weight of the 0-degree fibers of from about 925 $g/m^2$ to about 975 $g/m^2$.

Clause 7: The golf club of clause 1, wherein the tip end section is about cylindrical and has an outer diameter of from about 0.300 in. to about and 0.315 in.

Clause 8: The golf club of clause 7, wherein the grip end section has an outer diameter of from about 0.550" to 0.650", and wherein the outer diameter of the tapered section transitions from the outer diameter of the tip end section to the outer diameter of the grip end section.

Clause 9: The golf club of clause 1, wherein the golf club head has a center of gravity (CG), a geometric center (GC), a toe, and a heel, and wherein CG is located between the GC and the heel.

Clause 10: The golf club of clause 1, wherein at least 40% of the narrowed portion, by length along the longitudinal axis, has an outer diameter that is more than about 6% smaller than the reference surface.

Clause 11: The golf club of clause 1, wherein at least 50% of the narrowed portion, by length along the longitudinal axis, has an outer diameter that is more than about 7% smaller than the reference surface.

Clause 12: A golf club shaft comprising an elongate body formed from a fiber reinforced polymer and extending between a tip end and an opposite grip end, the elongate body comprising a tip end section abutting the tip end, wherein the tip end section is adapted to be secured within a golf club head, a grip end section abutting the grip end, and a tapered section interconnecting the tip end section and the grip end section, wherein the tapered section includes an upper 60% and a lower 60% along the longitudinal axis, the upper 60% abutting the grip end section, and the lower 60% abutting the tip end section, the tapered section further including, a reference portion at least partially located within the upper 60%, wherein the outer surface of the reference portion has a frustoconical shape with a near-constant taper rate, a narrowed portion at least partially located within the lower 60% and between the tip end and the reference portion, wherein the outer surface of the narrowed portion is recessed relative to a reference surface extrapolated from the frustoconical shape toward the tip end, wherein the narrowed portion comprises a plurality of fibers oriented parallel to the longitudinal axis (0-degree fibers), and wherein the elongate body has one of a bending stiffness of from about 192 CPM to about 222 CPM, an elastic modulus of the 0-degree fibers of from about 40 Msi to about 46 Msi, and a Fiber Areal Weight of the 0-degree fibers of from about 500 g/m$^2$ to about 575 g/m$^2$, a bending stiffness of from about 202 CPM to about 244 CPM, an elastic modulus of the 0-degree fibers of from about 40 Msi to about 46 Msi, and a Fiber Areal Weight of the 0-degree fibers of from about 635 g/m$^2$ to about 685 g/m$^2$, a bending stiffness of from about 234 CPM to about 260 CPM, an elastic modulus of the 0-degree fibers of from about 40 Msi to about 46 Msi, and a Fiber Areal Weight of the 0-degree fibers of from about 720 g/m$^2$ to about 770 g/m$^2$, a bending stiffness of from about 261 CPM to about 285 CPM, an elastic modulus of the 0-degree fibers of from about 40 Msi to about 46 Msi, and a Fiber Areal Weight of the 0-degree fibers of from about 805 g/m$^2$ to about 855 g/m$^2$, or a bending stiffness of from about 280 CPM to about 304 CPM, an elastic modulus of the 0-degree fibers of from about 43 Msi to about 49 Msi, and a Fiber Areal Weight of the 0-degree fibers of from about 925 g/m$^2$ to about 975 g/m$^2$.

Clause 13: The golf club shaft of clause 12, wherein at least 40% of the narrowed portion, by length along the longitudinal axis, has an outer diameter that is more than about 6% smaller than the reference surface.

Clause 14: The golf club shaft of clause 12, wherein at least 50% of the narrowed portion, by length along the longitudinal axis, has an outer diameter that is more than about 7% smaller than the reference surface.

Clause 15: The golf club shaft of clause 12, wherein the tip end section is about cylindrical and has an outer diameter of from about 0.300 in. to about and 0.315 in.

Clause 16: The golf club shaft of clause 15, wherein the grip end section has an outer diameter of from about 0.550" to 0.650", and wherein the outer diameter of the tapered section transitions from the outer diameter of the tip end section to the outer diameter of the grip end section.

Clause 17: The golf club shaft of clause 12, wherein the narrowed portion comprises a first region having a first taper rate (R1) and a second region having a second taper rate (R2), wherein the second region is between the first region and the reference portion, and wherein R2>R1.

Clause 18: The golf club shaft of clause 12, wherein the tapered section has a length of greater than about 30 inches, and wherein the first region is located entirely within about the first 15 of the tapered section closest to the tip end section.

Clause 19: A golf club comprising a golf club head comprising a strike face and a hosel, a shaft adapter secured within the hosel and defining an internal bore, a golf club shaft extending along a longitudinal axis between a tip end and a grip end and formed from a fiber reinforced polymer, wherein the golf club shaft includes a first region, a second region, a third region, a fourth region, and a fifth region, ordered from the tip end to the grip end, the first region including a cylindrical section having an outer diameter of from about 0.300 inches to about 0.315 inches and secured within the internal bore of the shaft adapter, the second region having a diameter that increases linearly as a function of distance from the tip at a first rate (R1), the third region having a diameter that increases linearly as a function of distance from the tip at a second rate (R2), the fourth region having a diameter that increases linearly as a function of distance from the tip at a third rate (R3), wherein R2>R1 and R2>R3, and a grip abutting the grip end of the shaft, wherein the fifth region is disposed within the grip.

Clause 20: The golf club of clause 19, wherein R2>R3>R1>0.

Clause 21: The golf club of clause 19, wherein the golf club shaft comprises a tapered section between the first region and the fifth region, and wherein the tapered region includes a reference portion at least partially located within the 60% of the tapered region closest to the fifth region, wherein the outer surface of the reference portion has a frustoconical shape with a near-constant taper rate, a narrowed portion at least partially within the 60% of the tapered region closest to the first region, wherein the outer surface of the narrowed portion is recessed relative to a reference surface extrapolated from the frustoconical shape in a direction toward the tip end.

Clause 22: The golf club of clause 21, wherein the second region and third region are within the narrowed portion, and wherein the near-constant taper rate is the third taper rate.

Clause 23: The golf club of clause 21, wherein at least 40% of the narrowed portion, by length along the longitudinal axis, has an outer diameter that is more than about 6% smaller than the reference surface.

Clause 24: A golf club shaft comprising an elongate body formed from a fiber reinforced polymer and extending between a tip end and an opposite grip end, the elongate body comprising a cylindrical tip end portion having an outer diameter of from about 0.300 in. to about 0.315 in, the cylindrical tip end portion abutting the tip end and operative to extend within a portion of a golf club head to facilitate joining of the golf club shaft with the golf club head, a first shaft region adjacent the cylindrical tip and having a diameter that increases at a first rate (R1), a second shaft region adjoining the first shaft region opposite the cylindrical tip, the second shaft region having a diameter that increases at a second rate (R2), a third shaft region adjoining the second shaft region opposite the first shaft region, the third shaft region having a diameter that increases at a third rate (R3), and a grip end portion adjoining the third shaft region, wherein R2>(R3 and R1).

Clause 25: The golf club shaft of clause 24, wherein the first shaft region comprises a plurality of fibers oriented parallel to the longitudinal axis (0-degree fibers), and wherein the elongate body has one of a bending stiffness of from about 192 CPM to about 222 CPM, an elastic modulus of the 0-degree fibers of from about 40 Msi to about 46 Msi, and a Fiber Areal Weight of the 0-degree fibers of from about 500 g/m$^2$ to about 575 g/m$^2$, a bending stiffness of from about 202 CPM to about 244 CPM, an elastic modulus of the 0-degree fibers of from about 40 Msi to about 46 Msi, and a Fiber Areal Weight of the 0-degree fibers of from about 635 g/m$^2$ to about 685 g/m$^2$, a bending stiffness of from about 234 CPM to about 260 CPM, an elastic modulus of the 0-degree fibers of from about 40 Msi to about 46 Msi, and a Fiber Areal Weight of the 0-degree fibers of from about 720 g/m$^2$ to about 770 g/m$^2$, a bending stiffness of from about 261 CPM to about 285 CPM, an elastic modulus of the 0-degree fibers of from about 40 Msi to about 46 Msi, and a Fiber Areal Weight of the 0-degree fibers of from about 805 g/m$^2$ to about 855 g/m$^2$, or a bending stiffness of from about 280 CPM to about 304 CPM, an elastic modulus of the 0-degree fibers of from about 43 Msi to about 49 Msi, and a Fiber Areal Weight of the 0-degree fibers of from about 925 g/m$^2$ to about 975 g/m$^2$.

The invention claimed is:

1. A golf club comprising:

a golf club head comprising a strike face and a hosel;

a shaft adapter secured within the hosel and defining an internal bore;

a golf club shaft formed from a fiber reinforced polymer and extending along a longitudinal axis between a tip end and a grip end, the golf club shaft including:

a tip end section abutting the tip end, wherein the tip end section is at least partially secured within the internal bore of the shaft adapter;

a grip end section abutting the grip end; and a tapered section interconnecting the tip end section and the grip end section, wherein the tapered section includes an upper 60% and a lower 60% along the longitudinal axis, the upper 60% abutting the grip end section, and the lower 60% abutting the tip end section, the tapered section further including:

a reference portion at least partially located within the upper 60%, wherein the outer surface of the reference portion has a frustoconical shape with a near-constant taper rate;

a narrowed portion at least partially located within the lower 60% and between the tip end and the reference portion, wherein the outer surface of the narrowed portion is recessed relative to a reference surface extrapolated from the frustoconical shape toward the tip end;

wherein the fiber reinforced polymer of the narrowed portion comprises a plurality of fibers oriented parallel to the longitudinal axis (0-degree fibers); and wherein the golf club shaft has one of:

a bending stiffness of from about 192 CPM to about 222 CPM, an elastic modulus of the 0-degree fibers of from about 40 Msi to about 46 Msi, and a Fiber Areal Weight of the 0-degree fibers of from about 500 g/m$^2$ to about 575 g/m$^2$:

a bending stiffness of from about 202 CPM to about 244 CPM, an elastic modulus of the 0-degree fibers of from about 40 Msi to about 46 Msi, and a Fiber Areal Weight of the 0-degree fibers of from about 635 g/m$^2$ to about 685 g/m$^2$:

a bending stiffness of from about 234 CPM to about 260 CPM, an elastic modulus of the 0-degree fibers of from about 40 Msi to about 46 Msi, and a Fiber Areal Weight of the 0-degree fibers of from about 720 g/m$^2$ to about 770 g/m$^2$;

a bending stiffness of from about 261 CPM to about 285 CPM, an elastic modulus of the 0-degree fibers of from about 40 Msi to about 46 Msi, and a Fiber Areal Weight of the 0-degree fibers of from about 805 g/m$^2$ to about 855 g/m$^2$; or a bending stiffness of from about 280 CPM to about 304 CPM, an elastic modulus of the 0-degree fibers of from about 43 Msi to about 49 Msi, and a Fiber Areal Weight of the 0-degree fibers of from about 925 g/m$^2$ to about 975 g/m$^2$.

2. The golf club of claim 1, wherein the narrowed portion comprises a first region having a first taper rate (R1) and a second region having a second taper rate (R2), wherein the second region is between the first region and the reference portion; and wherein R2>R1.

3. The golf club of claim 2, wherein the near-constant taper rate (R3) of the reference portion is less than R2.

4. The golf club of claim 3, wherein R1<R3.

5. The golf club of claim 1, wherein the tapered section has a length of greater than about 30 inches, and wherein a first region is located entirely within about the first 15 inches of the tapered section closest to the tip end section.

6. The golf club of claim 1, wherein the tip end section is about cylindrical and has an outer diameter of from about 0.300 in. to about and 0.315 in.

7. The golf club of claim 6, wherein the grip end section has an outer diameter of from about 0.550" to 0.650"; and wherein the outer diameter of the tapered section transitions from the outer diameter of the tip end section to the outer diameter of the grip end section.

8. The golf club of claim 1, wherein the golf club head has a center of gravity (CG), a geometric center (GC), a toe, and a heel; and wherein CG is located between the GC and the heel.

9. The golf club of claim 1, wherein at least 40% of the narrowed portion, by length along the longitudinal axis, has an outer diameter that is more than about 6% smaller than the reference surface.

10. The golf club of claim 1, wherein at least 50% of the narrowed portion, by length along the longitudinal axis, has an outer diameter that is more than about 7% smaller than the reference surface.

11. A golf club comprising:

a golf club head comprising a strike face and a hosel;

a shaft adapter secured within the hosel and defining an internal bore;

a golf club shaft extending along a longitudinal axis between a tip end and a grip end and formed from a fiber reinforced polymer, wherein the golf club shaft includes a first region, a second region, a third region, a fourth region, and a fifth region, ordered from the tip end to the grip end;

the first region including a cylindrical section having an outer diameter of from about 0.300 inches to about 0.315 inches and secured within the internal bore of the shaft adapter;

the second region having a diameter that increases linearly as a function of distance from the tip end at a first rate (R1);

the third region having a diameter that increases linearly as a function of distance from the tip end at a second rate (R2);

the fourth region having a diameter that increases linearly as a function of distance from the tip end at a third rate (R3);

wherein R2>R1 and R2>R3; and a grip abutting the grip end of the shaft, wherein the fifth region is disposed within the grip;

wherein the fiber reinforced polymer of the narrowed portion comprises a plurality of fibers oriented parallel to the longitudinal axis (0-degree fibers); and wherein the golf club shaft has one of:

a bending stiffness of from about 192 CPM to about 222 CPM, an elastic modulus of the 0-degree fibers of from about 40 Msi to about 46 Msi, and a Fiber Areal Weight of the 0-degree fibers of from about 500 g/m$^2$ to about 575 g/m$^2$:

a bending stiffness of from about 202 CPM to about 244 CPM, an elastic modulus of the 0-degree fibers of from about 40 Msi to about 46 Msi, and a Fiber Areal Weight of the 0-degree fibers of from about 635 $g/m^2$ to about 685 $g/m^2$;

a bending stiffness of from about 234 CPM to about 260 CPM, an elastic modulus of the 0-degree fibers of from about 40 Msi to about 46 Msi, and a Fiber Areal Weight of the 0-degree fibers of from about 720 $g/m^2$ to about 770 $g/m^2$;

a bending stiffness of from about 261 CPM to about 285 CPM, an elastic modulus of the 0-degree fibers of from about 40 Msi to about 46 Msi, and a Fiber Areal Weight of the 0-degree fibers of from about 805 $g/m^2$ to about 855 $g/m^2$; or a bending stiffness of from about 280 CPM to about 304 CPM, an elastic modulus of the 0-degree fibers of from about 43 Msi to about 49 Msi, and a Fiber Areal Weight of the 0-degree fibers of from about 925 $g/m^2$ to about 975 $g/m^2$.

12. The golf club of claim 11, wherein R2>R3>R1>0.

13. The golf club head of claim 11, wherein the first taper rate ranges between about 0.004 inch/inch and about 0.012 inch/inch.

14. The golf club head of claim 11, wherein the second taper rate ranges between about 0.015 inch/inch and 0.030 inch/inch.

15. The golf club head of claim 11, wherein the third taper rate ranges between about 0.005 inch/inch and about 0.014 inch/inch.

* * * * *